US012808619B2

(12) United States Patent
Foster

(10) Patent No.: US 12,808,619 B2
(45) Date of Patent: Nov. 24, 2026

(54) PIVOTABLE FOLLOWER FOR AMMUNITION MAGAZINE

(71) Applicant: FOSTECH, INC., Seymour, IN (US)

(72) Inventor: David Foster, Seymour, IN (US)

(73) Assignee: Fostech, Inc., Seymour, IN (US)

( * ) Notice: Subject to any disclaimer, the term of this patent is extended or adjusted under 35 U.S.C. 154(b) by 0 days.

(21) Appl. No.: 19/345,384

(22) Filed: Sep. 30, 2025

(65) Prior Publication Data

US 2026/0104218 A1 Apr. 16, 2026

Related U.S. Application Data

(60) Provisional application No. 63/702,121, filed on Oct. 1, 2024, provisional application No. 63/702,029, filed on Oct. 1, 2024.

(51) Int. Cl.
*F41A 9/73* (2006.01)
*F41A 9/58* (2006.01)

(52) U.S. Cl.
CPC . *F41A 9/73* (2013.01); *F41A 9/58* (2013.01)

(58) Field of Classification Search
CPC ..... F41A 9/73; F41A 9/74; F41A 9/75
See application file for complete search history.

(56) References Cited

U.S. PATENT DOCUMENTS 4,658,700 A * 4/1987 Sullivan ..... F41A 9/73 89/33.02
4,745,842 A * 5/1988 Shou-Fu ..... F41A 9/75 89/33.02
4,926,742 A * 5/1990 Ma ..... F41A 9/75 89/33.02
7,942,091 B2 * 5/2011 Winge ..... F41A 9/74 89/33.02
8,402,958 B2 * 3/2013 Victor ..... F41A 9/73 89/33.17
10,612,871 B2 * 4/2020 Davidson ..... F41A 9/75
2007/0107592 A1 * 5/2007 Snow ..... F41A 9/68 89/33.02
2010/0293830 A1 * 11/2010 Winge ..... F41A 9/02 42/49.01
2011/0041823 A1 * 2/2011 Victor ..... F41B 4/00 124/48
2016/0102931 A1 * 4/2016 Roberts ..... F41A 9/75 89/33.02

(Continued)

FOREIGN PATENT DOCUMENTS

WO WO-2020186181 A1 * 9/2020 ..... F41A 9/75

*Primary Examiner* — Jonathan C Weber
(74) *Attorney, Agent, or Firm* — Eric B. Fugett; Mark A. Pitchford; Pitchford Fugett, PLLC

(57) ABSTRACT

An ammunition magazine for a gun includes a magazine body and a follower. The magazine body defines an interior space in which a plurality of cartridges is receivable. The magazine body includes a drum portion and a tower portion. The drum portion defines a drum axis. The tower portion has an upper end with at least one feed lip thereon. The follower is received in the interior space and configured to bias cartridges received in the interior space from the drum portion up through the tower portion toward the at least one feed lip. An angle of the follower relative to the drum axis changes as the follower moves from the drum portion to the tower portion.

21 Claims, 19 Drawing Sheets

(56) References Cited

U.S. PATENT DOCUMENTS

| | | | | |
|---|---|---|---|---|
| 2019/0219349 | A1* | 7/2019 | Davidson | F41A 9/75 |
| 2021/0341241 | A1* | 11/2021 | Roberts | F41A 9/65 |
| 2023/0304758 | A1* | 9/2023 | Roberts | F41A 9/65 |

* cited by examiner

PIVOTABLE FOLLOWER FOR AMMUNITION MAGAZINE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This non-provisional patent application claims priority to U.S. Provisional Patent Application Ser. No. 63/702,029, filed Oct. 1, 2024 and titled "PIVOTABLE FOLLOWER FOR AMMUNITION MAGAZINE," and U.S. Provisional Patent Application Ser. No. 63/702,121, filed Oct. 1, 2024 and titled "FEED STOP FOR AMMUNITION MAGAZINE," the entire disclosures of each of which are hereby incorporated by reference.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to guns, and more particularly, to ammunition magazines for guns.

An ammunition magazine 1 is an ammunition storage and feeding device for a repeating firearm or other gun. Magazines can be either integral to the firearm (e.g., internal or fixed magazines) or externally attached (e.g., detachable magazines) to the firearm. Magazines generally function by holding multiple cartridges 2 and sequentially pushing each cartridge 2 into a position where it can be loaded into a firing chamber 102 of a gun barrel 104 by a moving action. Traditional detachable magazines typically include a magazine body in which cartridges are housed, a spring-biased follower in the body that pushes the cartridges toward the top 4 of the body, and a pair of opposing feed lips 6 at the top 4 of the body that engage the topmost cartridge 5 to prevent the cartridges 2 from being pushed out of the top 4 of the magazine by the follower.

Two of the most common types of detachable magazines are box type and drum type magazines. Box magazines can be straight, angled, or curved, depending on the shape and number of cartridges the magazine is designed to hold. Drum magazines are generally cylindrical in shape because they typically store cartridges in a single column spiral around the center portion of the magazine (known as the "drum body"). However, many modern drum magazines also include a vertical riser or "feed tower" that interfaces with a magazine well on the receiver of most modern firearms and directs ammunition from the drum body into the firing mechanism inside the receiver.

In many firearms, the moving action includes a reciprocating bolt 106. During cycling of such a firearm, the advancing bolt pushes a topmost cartridge 5 from the magazine 1 into the firing chamber 102 and cocks the gun.

The bolt 106 then retracts to extract and eject each spent shell casing after firing, and the cycle repeats until the last cartridge L is exhausted (i.e., removed) and no more cartridges 2 remain. In most semi-automatic and automatic firearms, including AR-platform firearms, the bolt 106 is carried by a bolt carrier 108 (known together as a "bolt carrier group" 110). The bolt 106 and bolt carrier 108 can be larger in diameter than the diameter 3 of the cartridges 2 being fed to the firing chamber 102 from the magazine 1. As exemplified in FIG. 1, this requires that such magazines 1 have a gap 7 or channel in a rear wall 8 at the top 4 of the magazine 1 that is wider than the diameter 3 of each cartridge 2 so that the relatively larger bolt 106 and bolt carrier 108 can pass through the gap 7 to contact and push a cartridge 2 into the firing chamber 102 during cycling of the firearm. In addition, a space 9 between feed lips 6 at the top 4 of the magazine must also be larger (i.e., wider) than the diameter 3 of the cartridges 2 in order to create clearance for the bolt 106 and bolt carrier 108 to pass through the gap 7 at the top 4 of the rear wall 8 of the magazine when chambering cartridges from the magazine. However, this arrangement can allow the follower to push cartridges out of the top 4 of the magazine through the gap 7 in the rear wall 8 and between the feed lips 6.

As shown in FIGS. 1-2, some currently available magazines known as "double stack" or "staggered stack" magazines 1 prevent the follower from pushing cartridges 2 out of the top 4 of the magazine 1 by orienting cartridges 2 inside the magazine in a zig zag pattern Z. Such magazines rely on the follower to transmit a pushing force upward and at an angle back and forth through each cartridge 2 in the magazine 1 from the bottommost cartridge to the topmost cartridge 5 so as to hold the topmost cartridge 5 against one of the magazine feed lips 6. However, this "double stack" method is not feasible for all types of detachable magazines.

For example, double stacking cartridges in this way does not work with drum magazines due to challenges associated with transitioning modern tapered cartridges from a rotary orientation to linear orientation where the drum body hands off cartridges into the vertical riser or feed tower. Specifically, the taper of each cartridges causes the cartridges to adopt a curved shape C (as exemplified in FIG. 5) as they stack up against each other in the linear feed tower. The resulting curved shape C of the cartridge stack can prevent cartridges from staying tangent to the feed lips during cycling of the gun and in turn interrupt smooth feeding of ammunition into the firing chamber. The change in cartridge orientation through the magazine can also tangle or bind up traditional follower springs and cause traditional followers to block the path of the bolt 106 as it advances to push the last cartridge L toward the firing chamber 102 of the gun barrel 104 (as exemplified in FIG. 6). For these reasons, all known drum magazines orient cartridges in a single column (i.e., "single stack") around the drum body and up through the riser or feed tower. These limitations have also historically prevented drum magazines from being usable with firearms and other guns that have a bolt 106 or bolt carrier 108 that is larger than the diameter 3 of the cartridges 2 the weapon is designed to fire.

Accordingly, what is needed are improvements in ammunition magazines for firearms.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide an ammunition magazine for a gun having a bolt or bolt carrier larger than a diameter of the cartridges the gun is designed to fire and which permits single stacking of tapered cartridges in the magazine while also maintaining the cartridges tangent to the feed lip and preventing the bolt from crashing into the follower as the bolt advances to push the last cartridge toward the firing chamber of the gun. To this end, embodiments of the ammunition magazines disclosed herein include a magazine body having drum and tower portions, and a novel follower that changes its angle relative to an axis of the drum as the follower moves from the drum portion to the tower portion during feeding of ammunition. The follower is configured to move around the drum portion substantially parallel to the drum axis and then pivot at an angle to the drum axis as the follower moves up through the tower portion of the magazine body. The follower is configured to present a last cartridge received in the interior space tangent to a feed lip and then rest within the tower portion of the magazine body out of the way of the bolt carrier group as the bolt and bolt carrier advance longitudinally forward to push the last cartridge in the magazine toward the firing chamber of the gun barrel.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
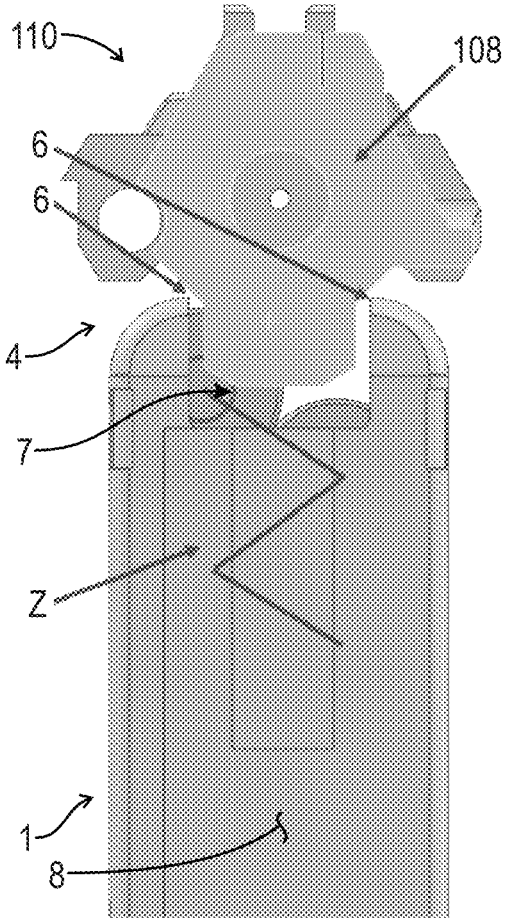
FIG. 1 (PRIOR ART)
FIG. 1 is a fragmentary rear view of the upper end of a prior art double stack box magazine for a firearm containing a plurality of cartridges with an exemplar bolt carrier group positioned against a rear end of the topmost cartridge in the magazine ready to push the topmost cartridge toward a firing chamber of the firearm. The bolt carrier group is shown sectioned for clarity.
Figure 2:
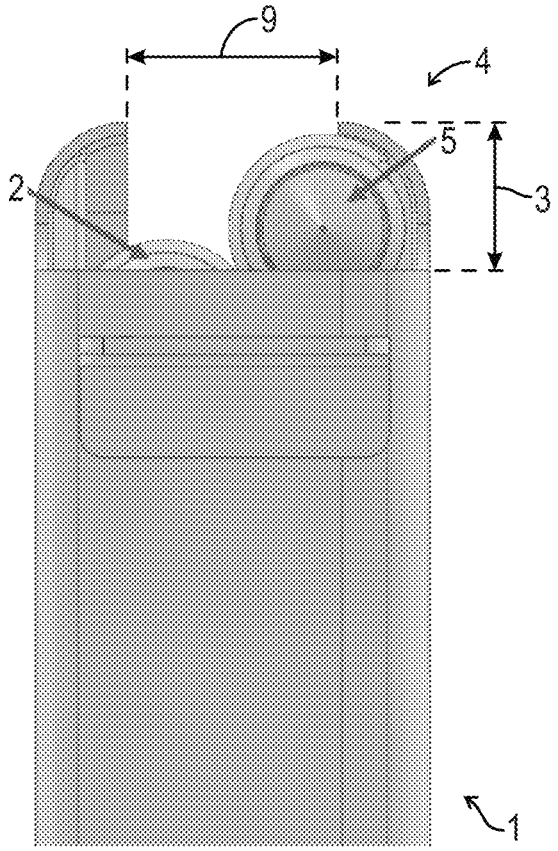
FIG. 2 (PRIOR ART)
FIG. 2 is a fragmentary front view of the upper end of the prior art double stack box magazine of FIG. 1.
Figure 3:
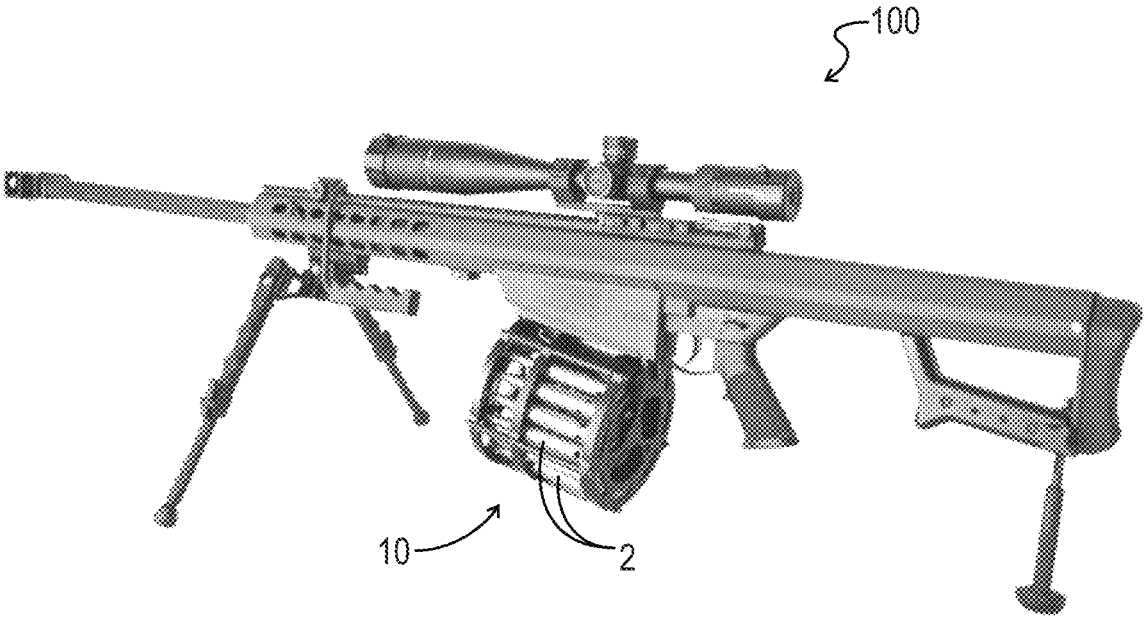
FIG. 3 is an elevated left side perspective view of a firearm having a receiver with a magazine well in which an embodiment of an ammunition magazine containing an embodiment of a novel pivotable follower constructed in accordance with the present invention is received. The magazine is depicted fully loaded with tapered .50 caliber cartridges.

As described herein, an "upright" position is considered to be the position of apparatus components while in proper operation or in a natural resting position as described and shown herein, for example, in FIG. 3. The upright firing position of a firearm is a generally level firing position. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

As used herein, the terms "front" and "forward" means in a direction extending toward the muzzle of the firearm. In some cases, the term "forward" can also mean forward beyond the muzzle of the firearm. The terms "aft" and "rear" means in a direction extending away from the muzzle of the firearm toward a rear end of a firearm. In some cases, the term "rearward" can also mean rearward beyond the rear end of the firearm.

As used herein, the term "gun" means a weapon incorporating a tube from which one or more projectiles are propelled by an explosive force or a compressed gas. For the avoidance of doubt, the term "gun" includes firearms, airguns, grenade launchers, cannons, and the like.

As used herein, the term "cartridge" means a preassembled ammunition packaging one or more projectiles within a case that is made to fit within a firing chamber of a breechloading gun barrel. A "cartridge" can also include a propellant substance and an ignition device packaged within the case. In some embodiments, a "cartridge" can be a monolithic projectile for an airgun.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. In the absence of a reference parameter from the context surrounding its use, the term "substantially" as used herein means what is considered normal or possible within the limits of applicable industry-accepted manufacturing practices and tolerances.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring now generally to FIGS. 3-20, there is depicted an ammunition magazine 10 for a firearm 100 equipped with an embodiment of a pivotable follower 50 constructed in accordance with the present invention. The magazine 10 is a drum type magazine with a magazine body 12 designed to contain a plurality of cartridges 2. The magazine body 12 defines an interior space 15 in which the cartridges 2 are received in a single column or "single stack" orientation. The magazine body 12 includes a cylindrical drum portion 18 and a linear feed tower portion 20. The drum portion 18 includes a drum axis 17. The drum axis 17 extends along a center axle 58. The center axle 58 defines the drum axis 17. Rear and front sprockets 46, 48 are mounted on the center axle 58. The sprockets 46, 48 are longitudinally spaced along the center axle 58. The sprockets 46, 48 include a plurality of radial projections or "teeth" and a plurality of concavities 45 between each respective pair of adjacent teeth along the circumferential edge of each sprocket 46, 48. Each concavity 45 in the rear sprocket 46 is sized and shaped to receive a rear portion of a cartridge 2. Each concavity 45 in the front sprocket 48 is sized and shaped to receive a forward portion or "neck" of a cartridge 2. The concavities 45 in the rear sprocket 46 align longitudinally with the concavities 45 in the front sprocket 45 to form a plurality of cartridge seats 47 in which cartridges 2 ride around the drum 18 when received in the interior space 15 of the drum 18.

The follower 50 is housed in the interior space 15. The follower 50 is arranged to ride around the drum 18 on the sprockets 46, 48 with the cartridges 2 received in the cartridge seats 47. The follower 50 is arranged to push cartridges 2 riding on the sprockets 46, 48 from the drum 18 up through the feed tower 20 toward an upper end 16 of the magazine body 12. More specifically, cartridges 2 stored in the interior space 15 of the drum 18 are advanced around the drum axis 17 by the sprockets 46, 48 and then pushed by the follower 50 up through the feed tower 20 to the upper end 16 of the magazine. The upper end 16 of the magazine body 12 toward which the follower 50 pushes the cartridges 2 is an upper end 16 of the feed tower 20.

The feed tower 20 includes opposing left and right tower sidewalls 22, 24, a front wall 26, and a rear wall 28. The rear wall 28 defines a gap 30 through which a portion of an advancing bolt 106 and bolt carrier 108 of the firearm 100 can pass when moving a topmost cartridge 5 from the upper end 16 of the magazine into the firing chamber 102 of the firearm 100. The gap 30 has a width 33 that is greater than a diameter 3 of the cartridges 2. The width 33 of the gap 30 is also greater than a width 103 of the portion of the advancing bolt 106 and bolt carrier 108. A single feed lip 40 is detachably connected to the upper end 16 of the left feed tower sidewall 22 via fasteners 32. The feed lip 40 defines a hollow space 42 in which the topmost cartridge 5 is receivable. In this way, the feed lip 40 is shaped and sized to receive and engage the topmost cartridge 5 as the cartridges 2 are biased from the drum 18 and up through the feed tower 20 by the follower 50. When connected to the feed tower sidewall 22, the feed lip 40 forms part of the upper end 16 of the magazine 10 toward which cartridges 2 are pushed by the follower 50. Consequently, the follower 50 biases the cartridges 2 from the drum 18 and up through the feed tower 20 toward the feed lip 40.

Figure 4:
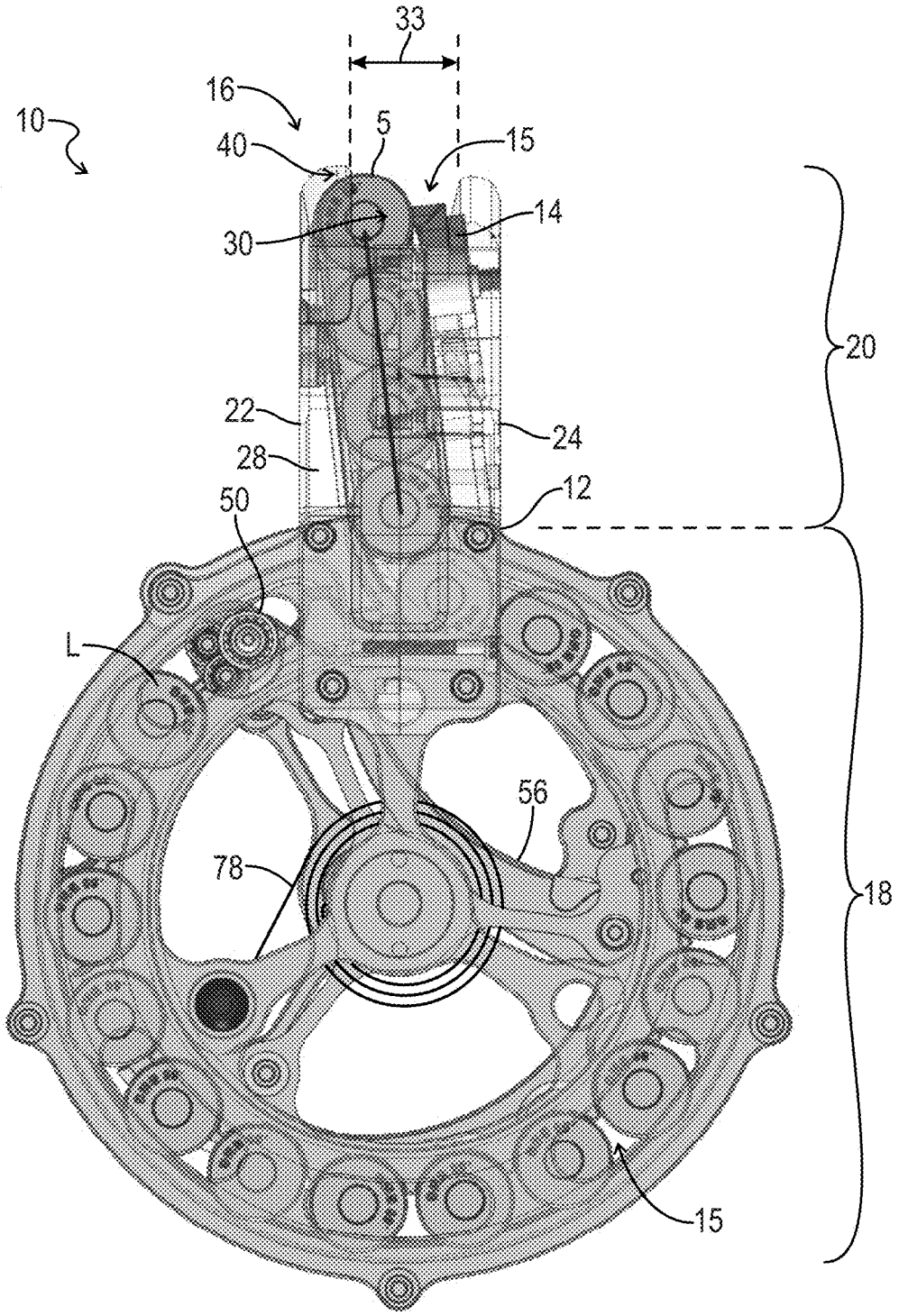
FIG. 4 is a rear elevational view of the ammunition magazine of FIG. 3 showing the cartridges in a single stack orientation with the pivotable follower biasing the cartridges around the drum and up through the feed tower. Cartridges inside the feed tower are depicted in dashed lines for clarity.
Figure 5:
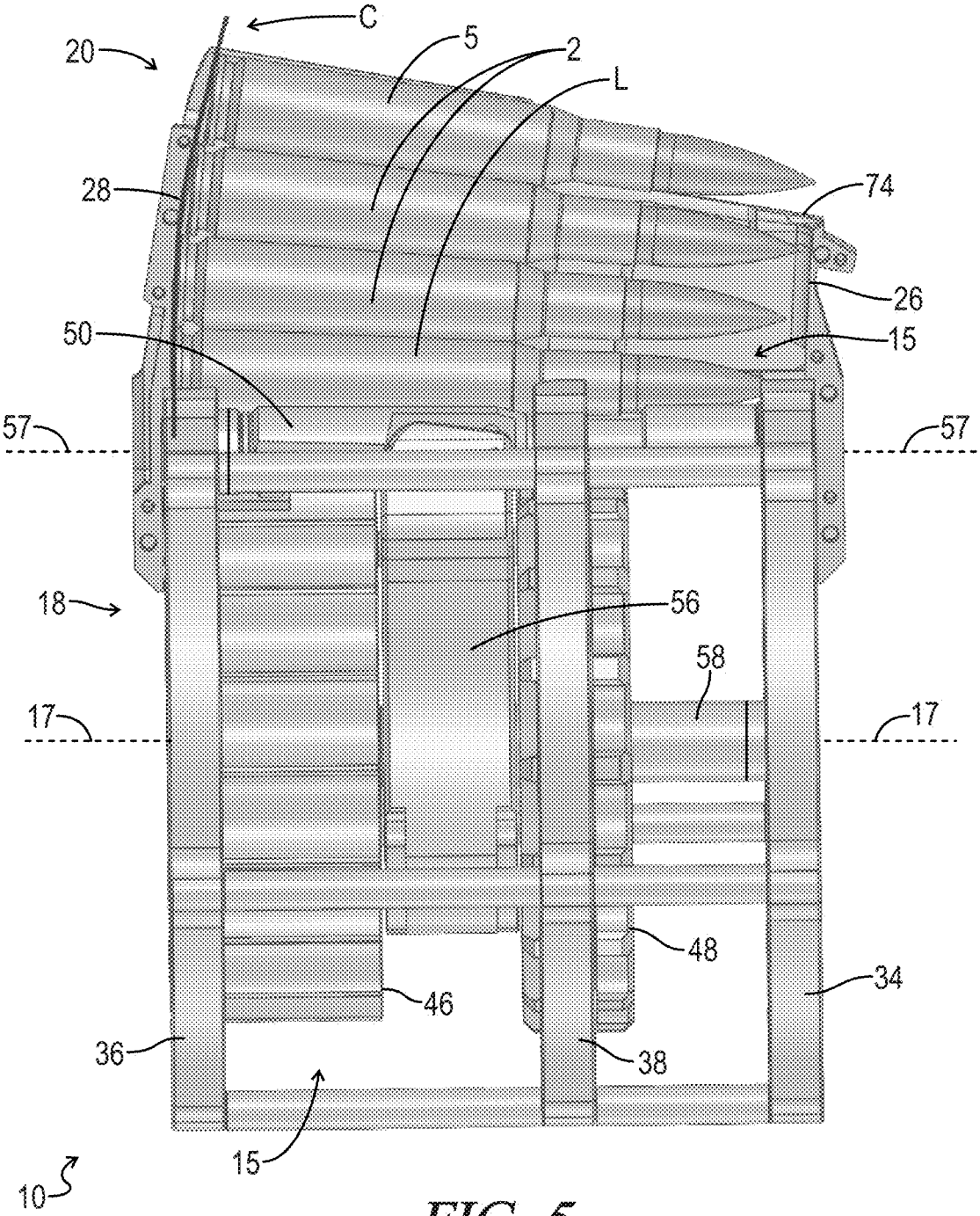
FIG. 5 is a right-side elevational side view of the ammunition magazine of FIG. 3 with the right feed tower sidewall and many of the cartridges omitted for clarity. The pivotable follower is positioned at the top of the drum parallel to the drum axis and ready to move up into the feed tower upon removal from the magazine body of the topmost cartridge.
Figure 6:
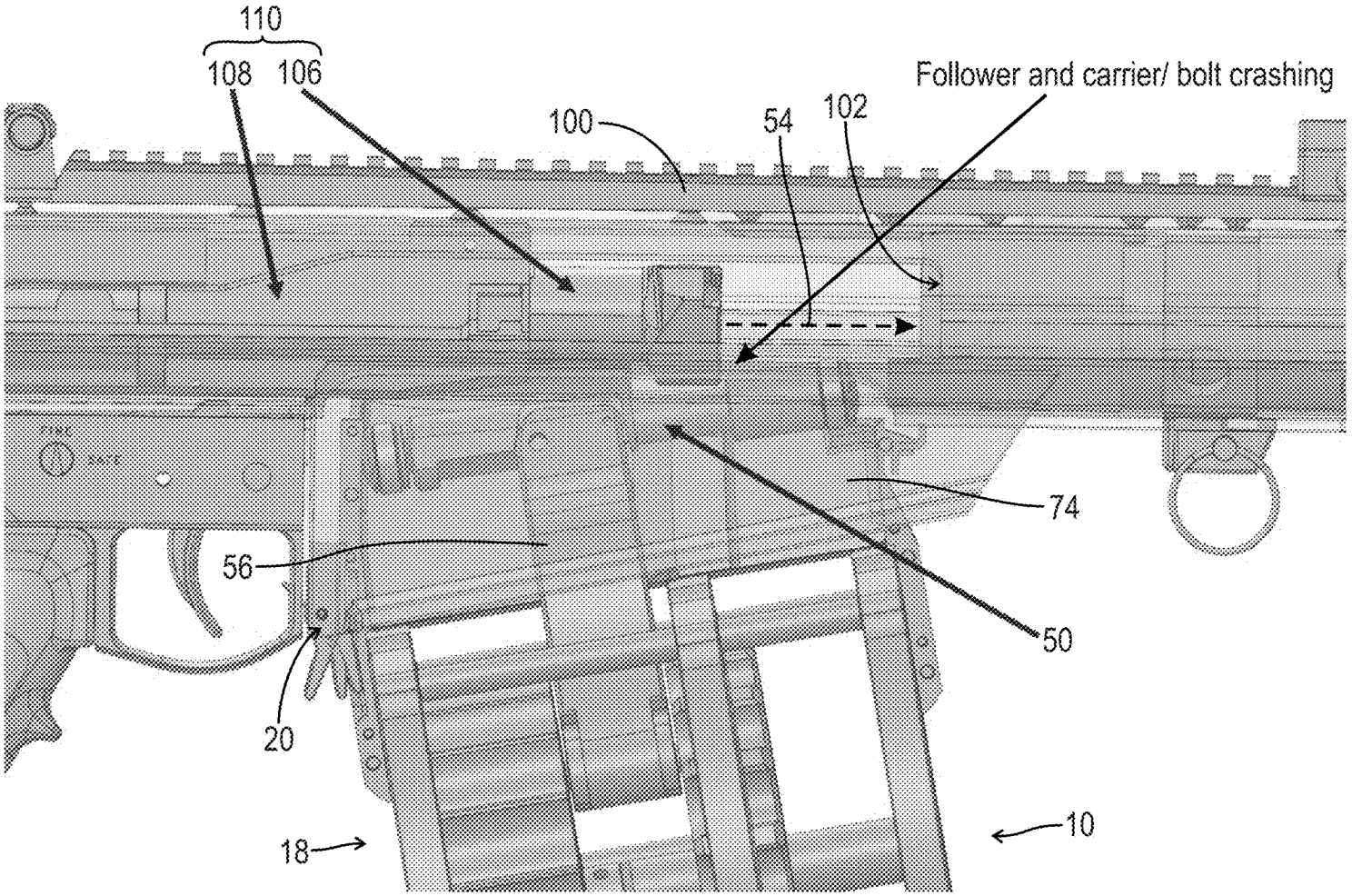
FIG. 6 is a right-side elevational view of the ammunition magazine of FIG. 5 empty of cartridges and showing the pivotable follower hypothetically positioned at the top of the feed tower as if the follower were unable to pivot. The exemplar bolt carrier group of FIG. 1 is depicted crashing into the follower while moving longitudinally forward as if the bolt were pushing the topmost cartridge toward a firing chamber of the firearm.

A feed stop 14 is pivotably connected to a side interior surface 44 of the right feed tower sidewall 24 at the upper end 16 of the magazine body 12 opposite the feed lip 40. The feed stop 14 is spaced from the left feed tower sidewall 22 and the feed lip 40. The feed stop 14 is spring-biased to press the topmost cartridge 5 against the feed lip 40 in a direction that is transverse to a longitudinal axis of the topmost cartridge 5. More specifically, the feed stop 14 is pivotable between an extended position and a depressed position. In the depressed position, the feed stop 14 does not engage the topmost cartridge 5. In the extended position, the feed stop 14 engages the topmost cartridge 5 and exerts a pressing force against a side of the topmost cartridge 5 to press the topmost cartridge 5 in a side direction against the feed lip 40, as best shown in FIG. 4. In combination with a pushing force transmitted by the follower 50 to the bottommost (i.e., last) cartridge L and through the intervening cartridges 2 to the topmost cartridge 5, the feed stop 14 holds the topmost cartridge 5 horizontally in the hollow space 42 underneath the uppermost tip of the feed lip 40 either until the topmost cartridge 5 is manually removed from the magazine 10 or the bolt carrier group 110 pushes the topmost cartridge 5 toward the firing chamber 102 of the gun barrel 104. The feed stop 14 thus works in combination with the feed lip 40 to prevent the cartridges 2 from being pushed out of the upper end 16 of the magazine 10 by the follower 14, thereby overcoming the deficiencies of the prior art associated with single stack ammunition magazines for firearms with bolts 106 and bolt carriers 108 that are larger than cartridges the firearms are designed to fire.

Figure 7:
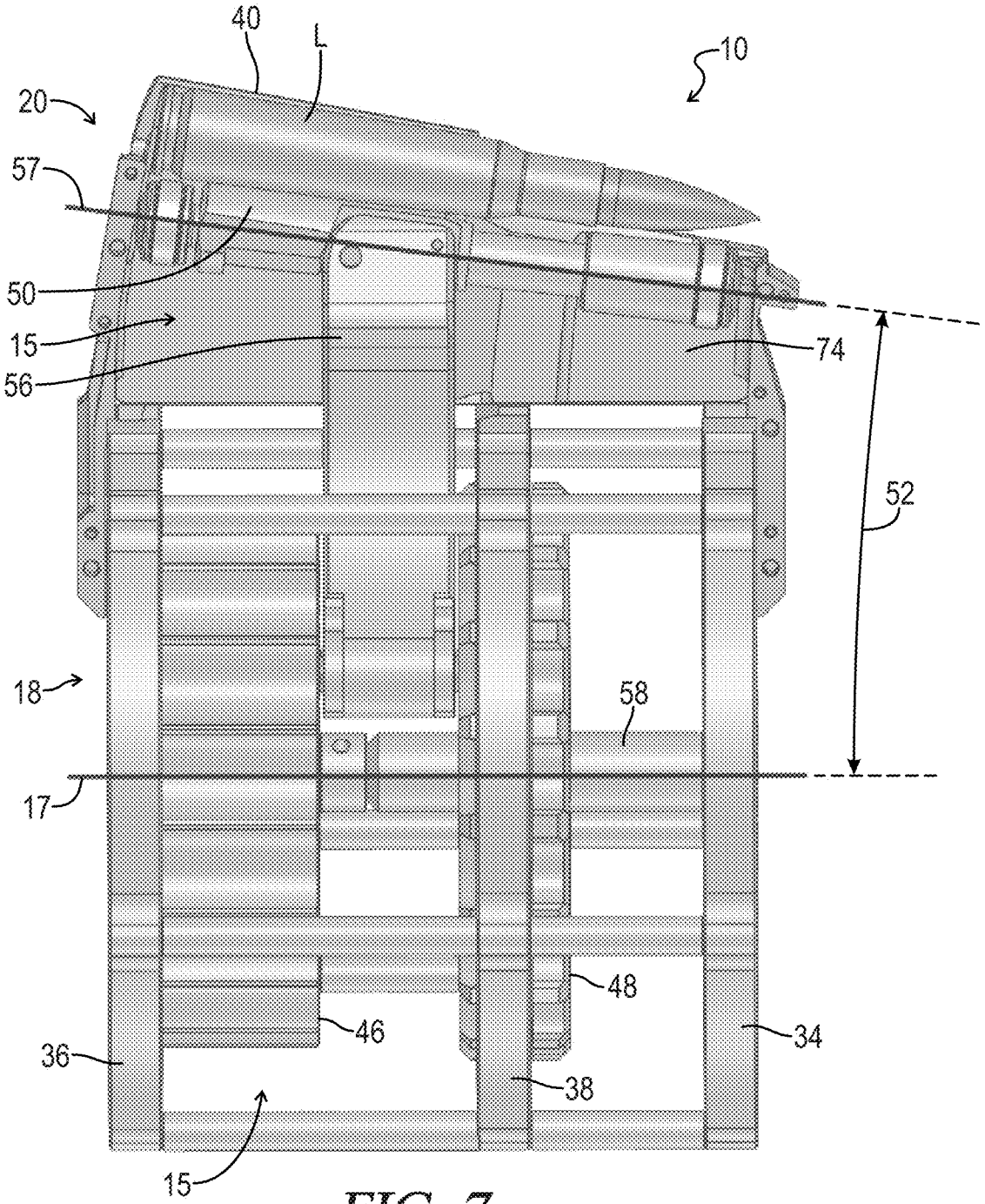
FIG. 7 is a right-side elevational side view of the ammunition magazine of FIG. 5 showing the pivotable follower positioned at the top of the feed tower at an angle to the drum axis and holding the last cartridge tangent against the feed lip.

As noted above and exemplified in FIG. 5, tapered cartridges 2 undesirably form a radius by adopting a curved shape C when linearly stacked inside a magazine, which can in turn prevent cartridges from staying tangent to the magazine feed lip(s) and cause feeding problems during cycling of the gun. Traditional followers have so far been unable to address this issue without also causing the advancing bolt 106 to crash into (i.e., contact) the follower during forward movement of the bolt 106, as hypothetically exemplified in FIG. 6. To surmount these problems, the novel follower 50 disclosed herein is designed to change its angle 52 relative to the drum axis 17 as the follower 50 moves from the drum 18 to the feed tower 20 of the magazine body 12. That is, the follower 50 defines a follower axis 57 and the angle 52 of the follower axis 57 relative to the drum axis 17 changes as the follower 50 moves from the drum 18 to the feed tower 20. For example, in some embodiments, the follower 50 is designed to move around the drum 18 (e.g., in a cartridge seat 47 on the sprockets 46, 48) with the follower axis 57 substantially parallel to the drum axis 17 and then pivot relative to the drum axis 17 and move up through the feed tower 20 with the follower axis 57 at an angle 52 to the drum axis 17. As best shown in FIG. 7, this ensures that the follower 50 presents each cartridge 2 received in the interior space, including the last L cartridge, tangent to the feed lip 40 and biases each cartridge 2, including the last L cartridge, evenly against the feed lip 40.

Figure 8:
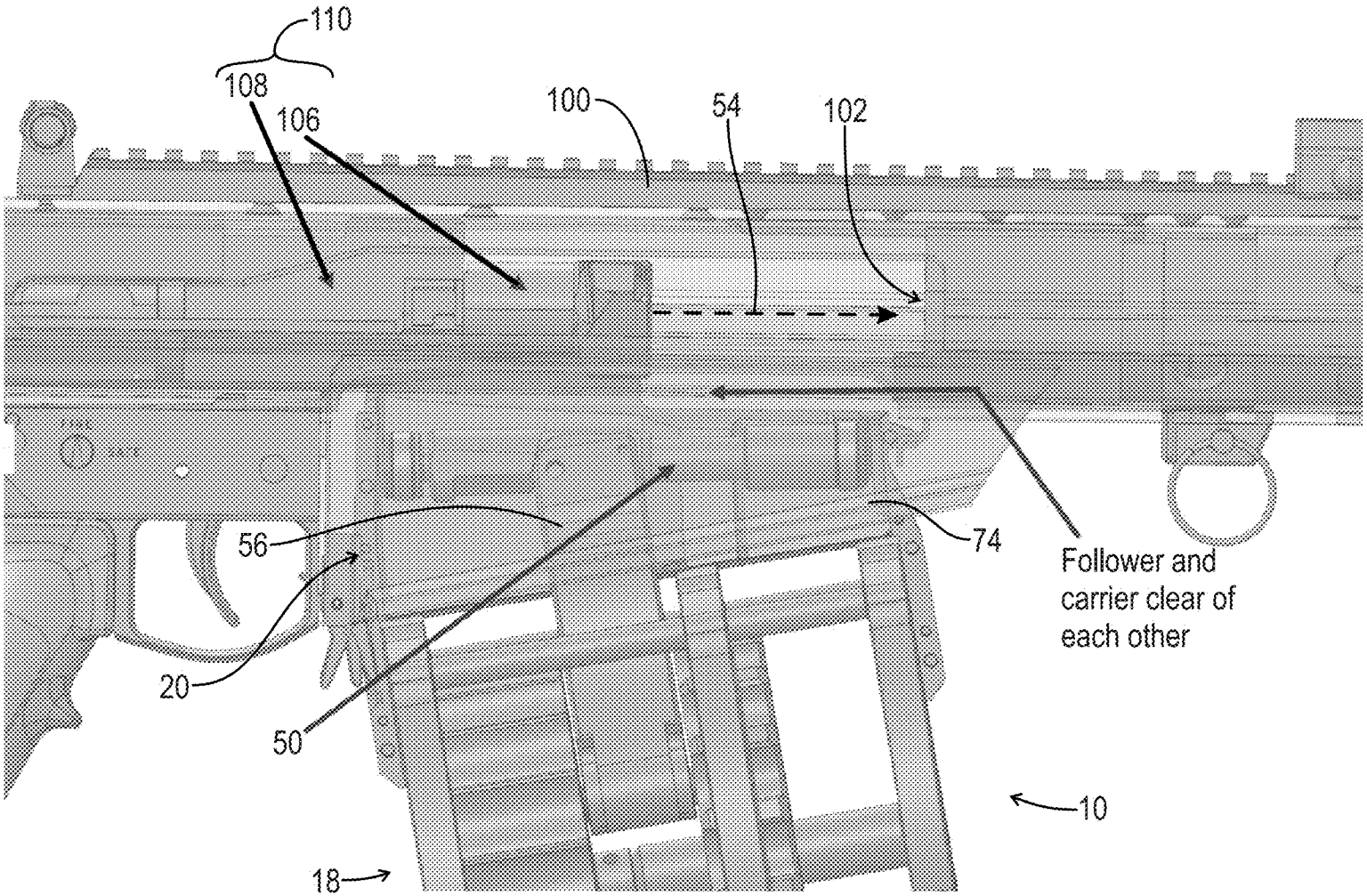
FIG. 8 is a right-side elevational side view of the objects of FIG. 6 showing the pivotable follower at rest at the top of the feed tower below the path of the advancing bolt.
Figure 9:
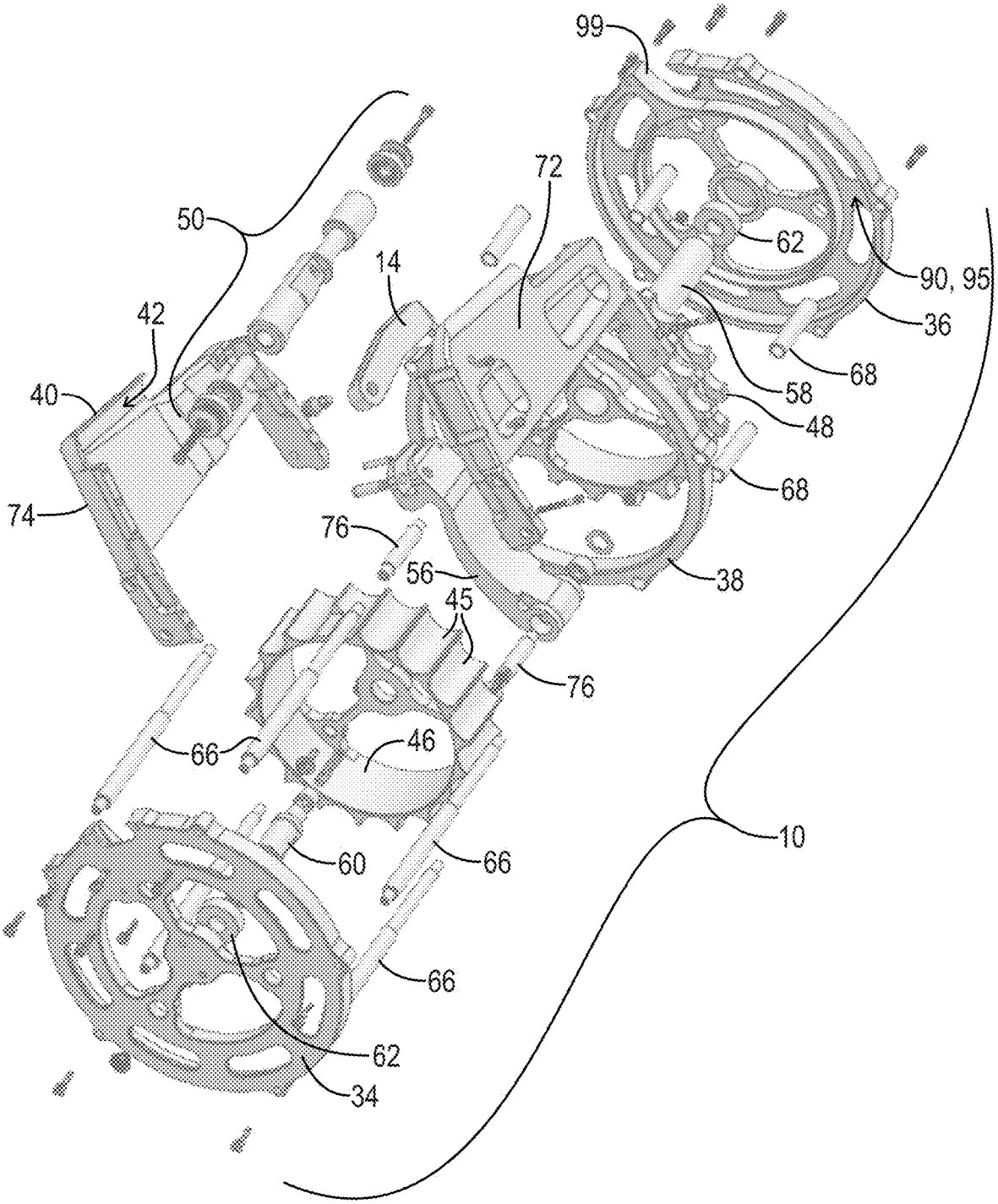
FIG. 9 is an elevated exploded rear right-side isometric view of the ammunition magazine of FIG. 3. The cartridges, various threaded fasteners, and a clock spring (i.e., mainspring) are omitted for clarity.
Figure 10:
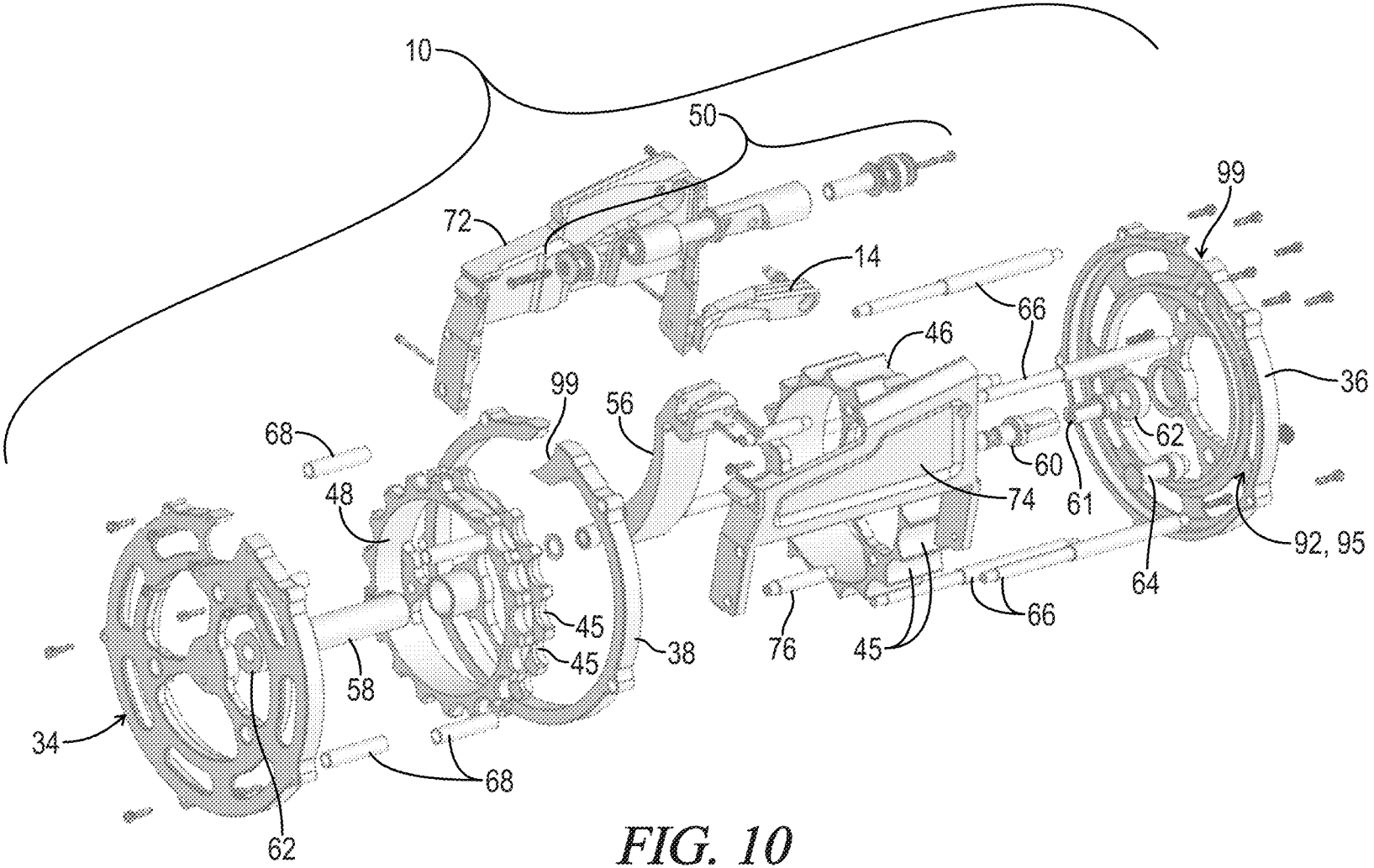
FIG. 10 is an elevated exploded front left-side isometric view of the objects of FIG. 9.
Figure 11:
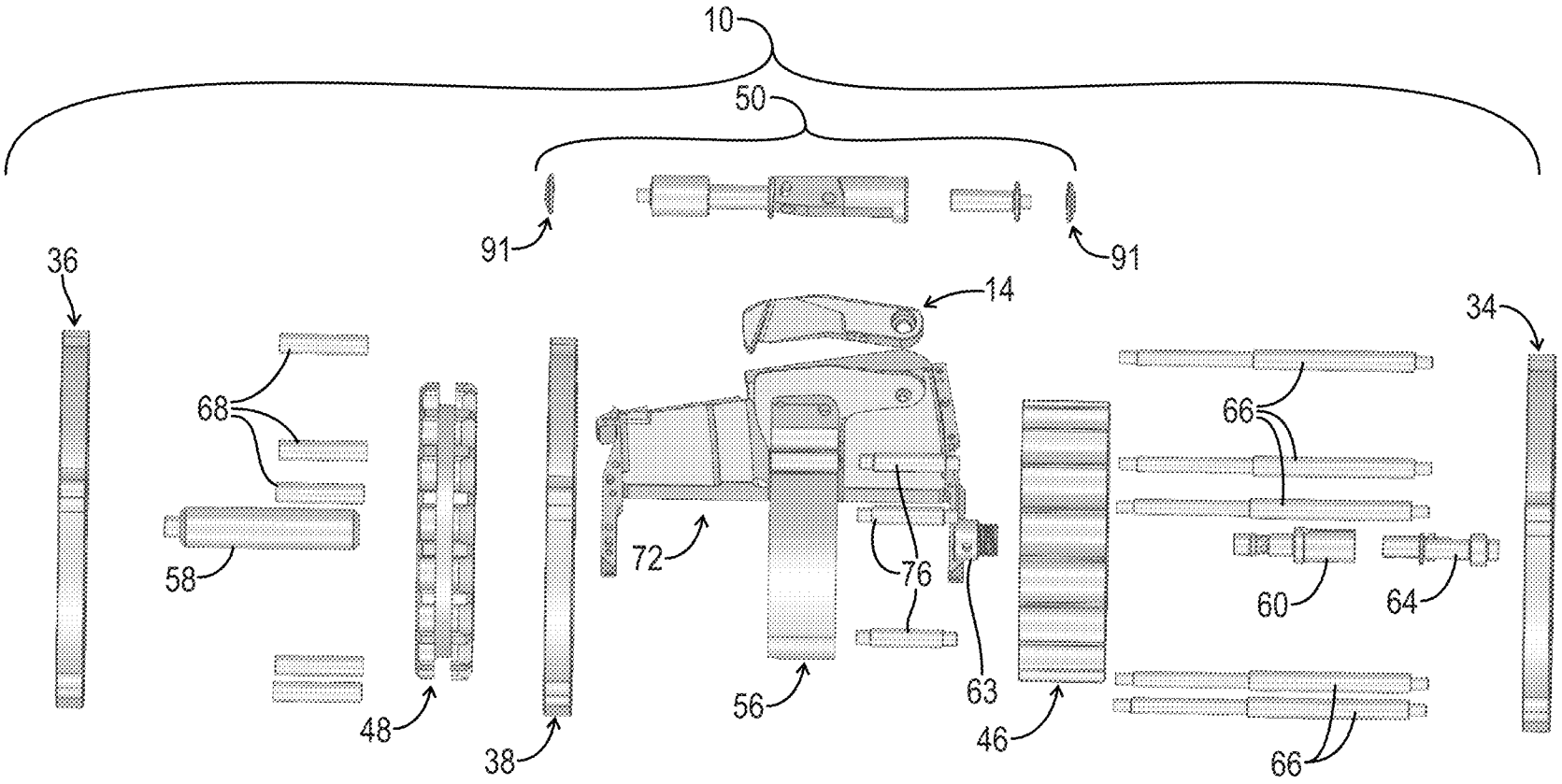
FIG. 11 is an exploded left-side elevational view of the ammunition magazine of FIG. 3. The cartridges, various threaded fasteners, and clock spring are omitted for clarity.
Figure 12:
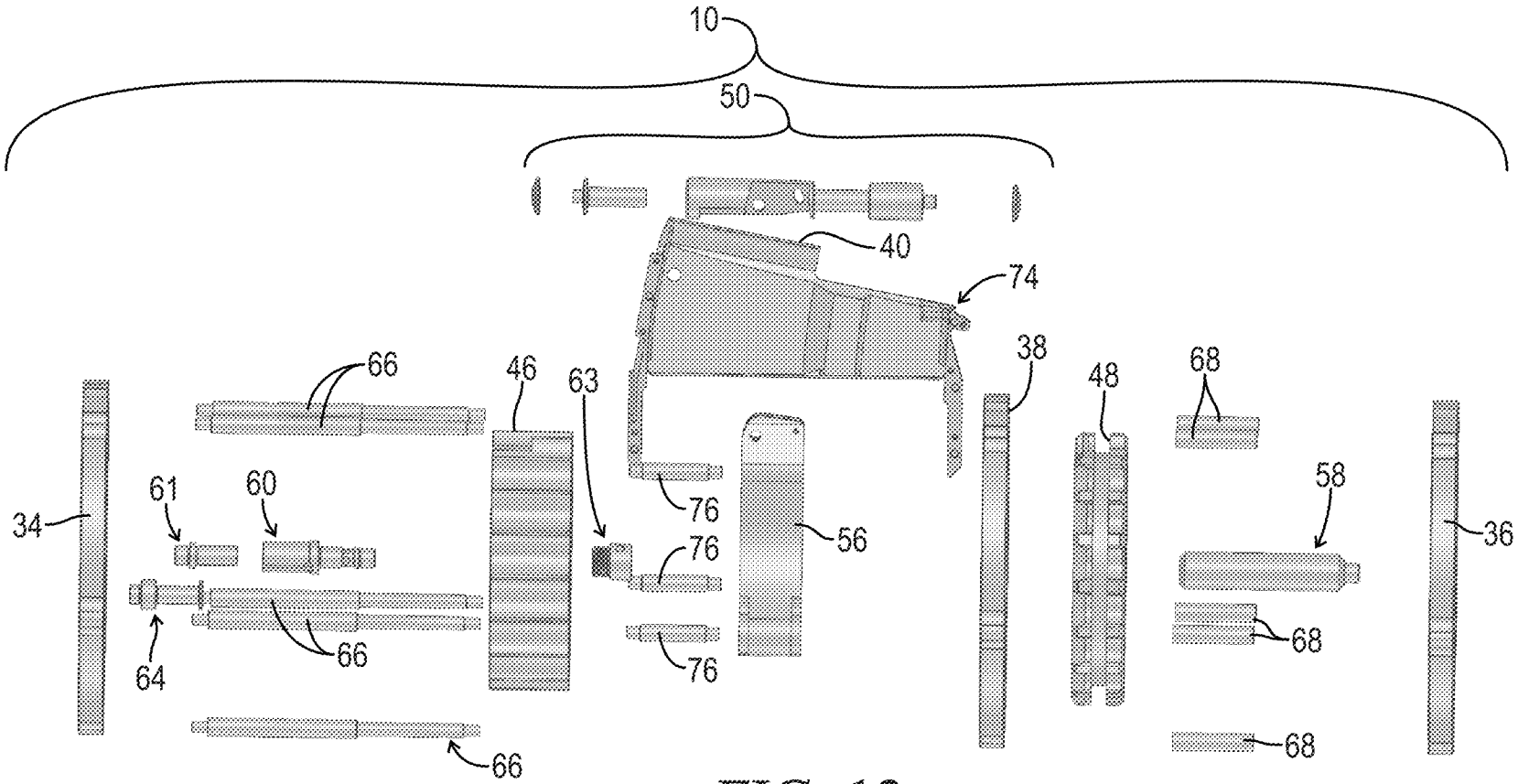
FIG. 12 is an exploded right-side elevational view of the objects of FIG. 11.
Figure 13:
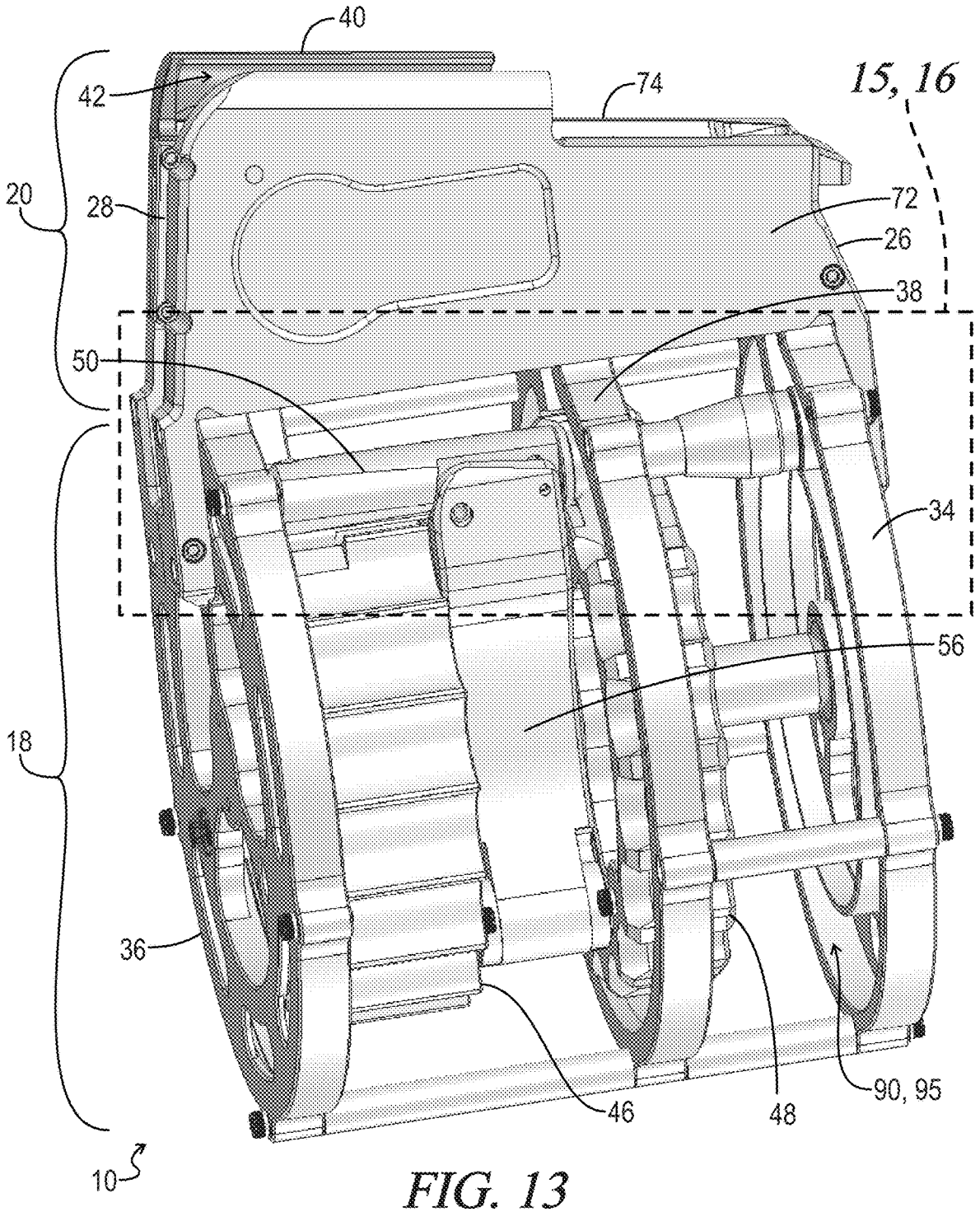
FIG. 13 is an elevated rear right-side isometric view of the ammunition magazine of FIG. 3 with the cartridges omitted for clarity and the pivotable follower positioned at the top of the drum ready to move up into the feed tower as shown in FIG. 5.
Figure 14:
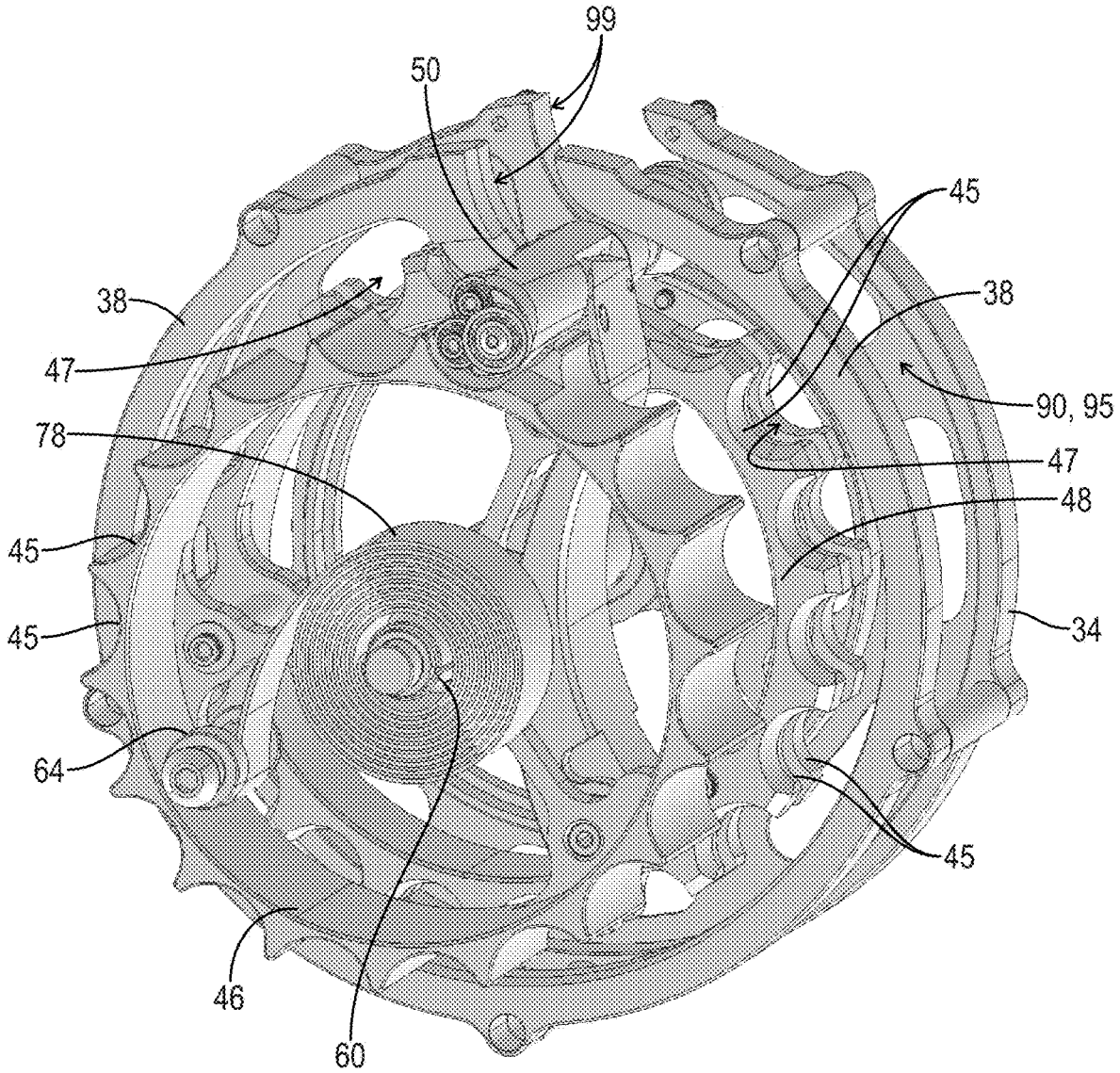
FIG. 14 is an elevated rear right-side isometric view of the ammunition magazine of FIG. 13 with the rear drum plate, rear drum plate spacers, rear feed ramp, and feed tower omitted for clarity.
Figure 15:
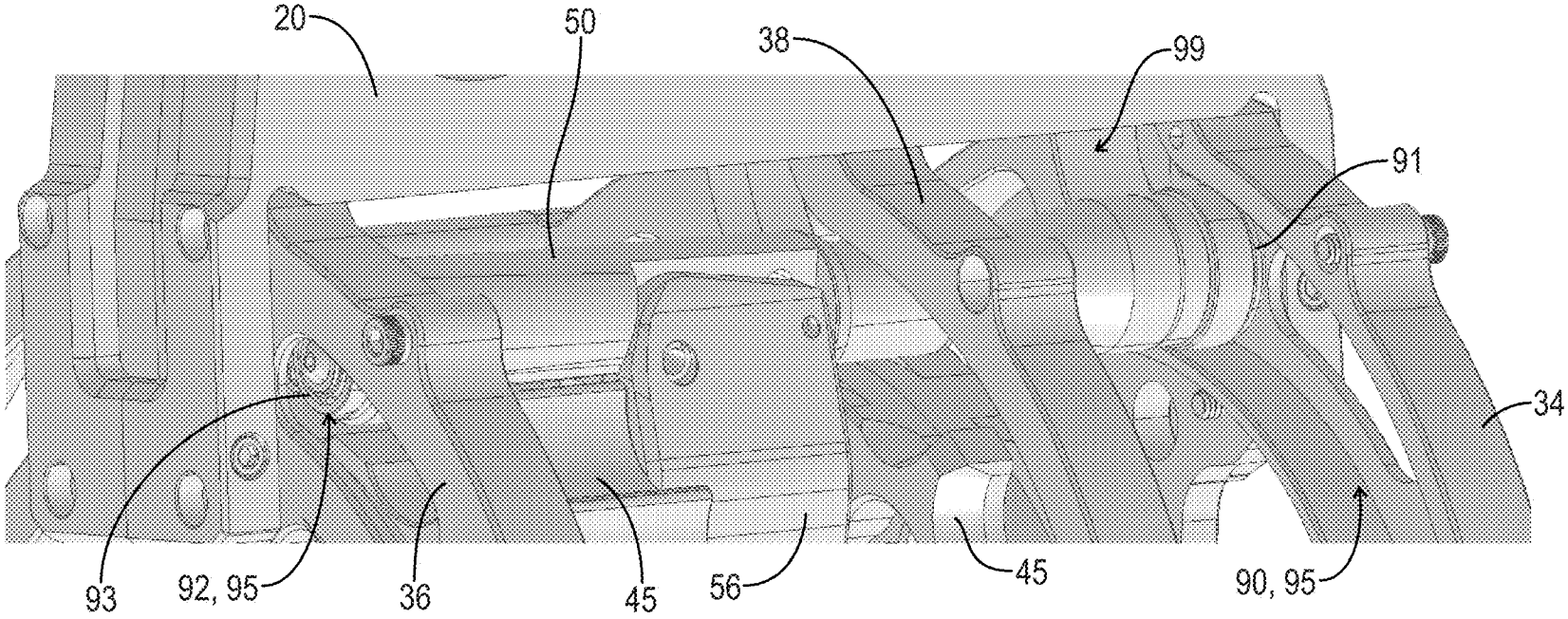
FIG. 15 is a magnified rear right-side detail view of the objects of FIG. 13 at location A.
Figure 16:
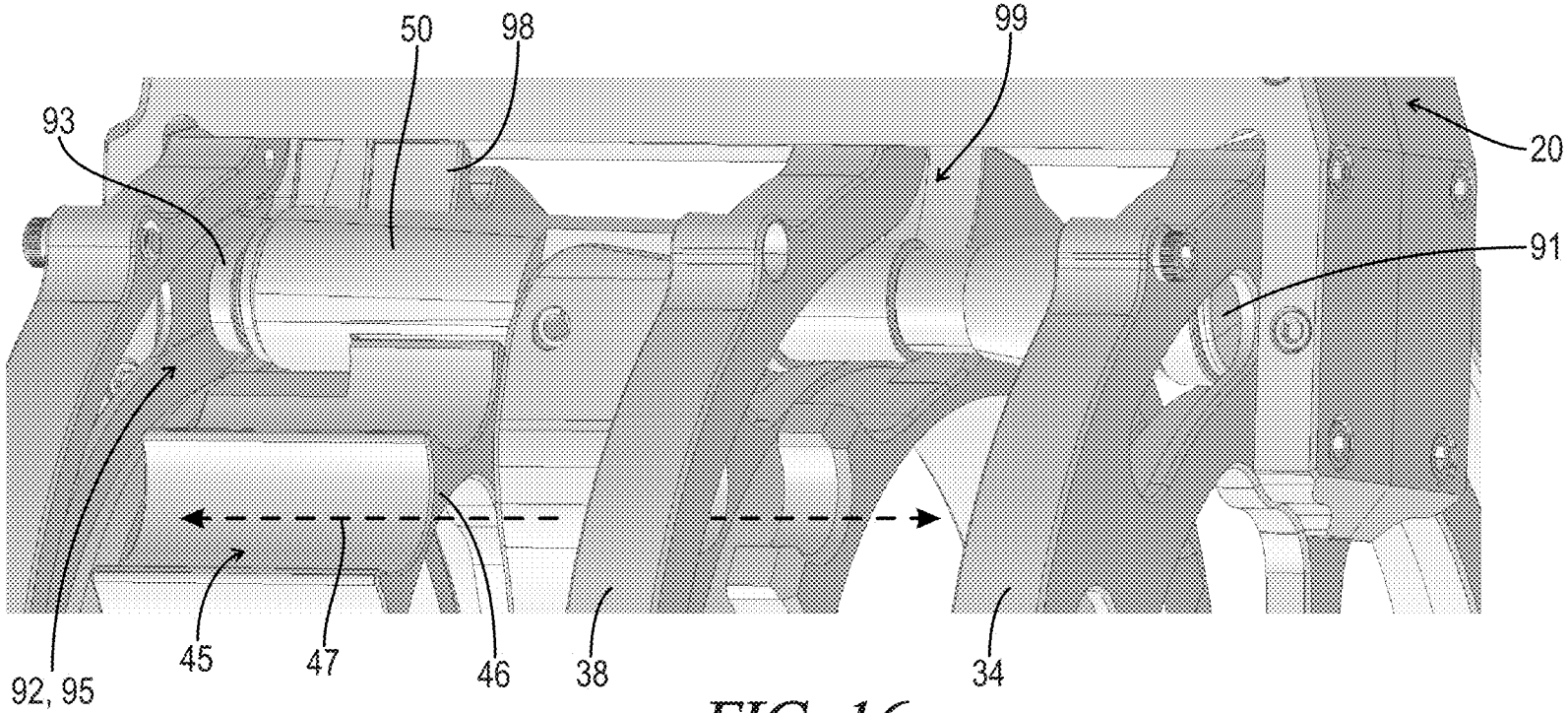
FIG. 16 is a magnified front right-side detail view of the objects of FIG. 13 at location A.
Figure 17:
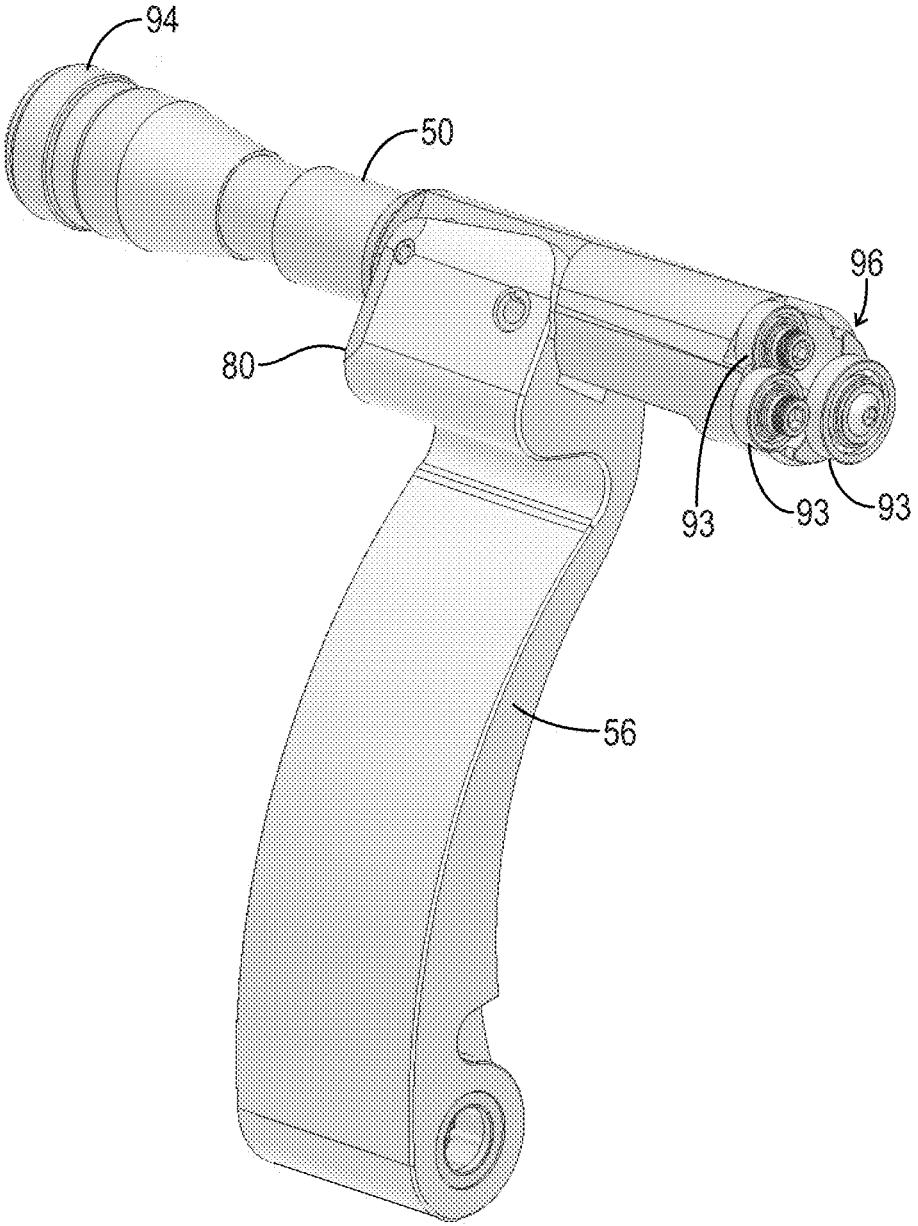
FIG. 17 is an elevated rear left-side isometric detail view of the pivotable follower of FIG. 13 showing the pivotable follower in an extended position relative to the follower arm.
Figure 18:
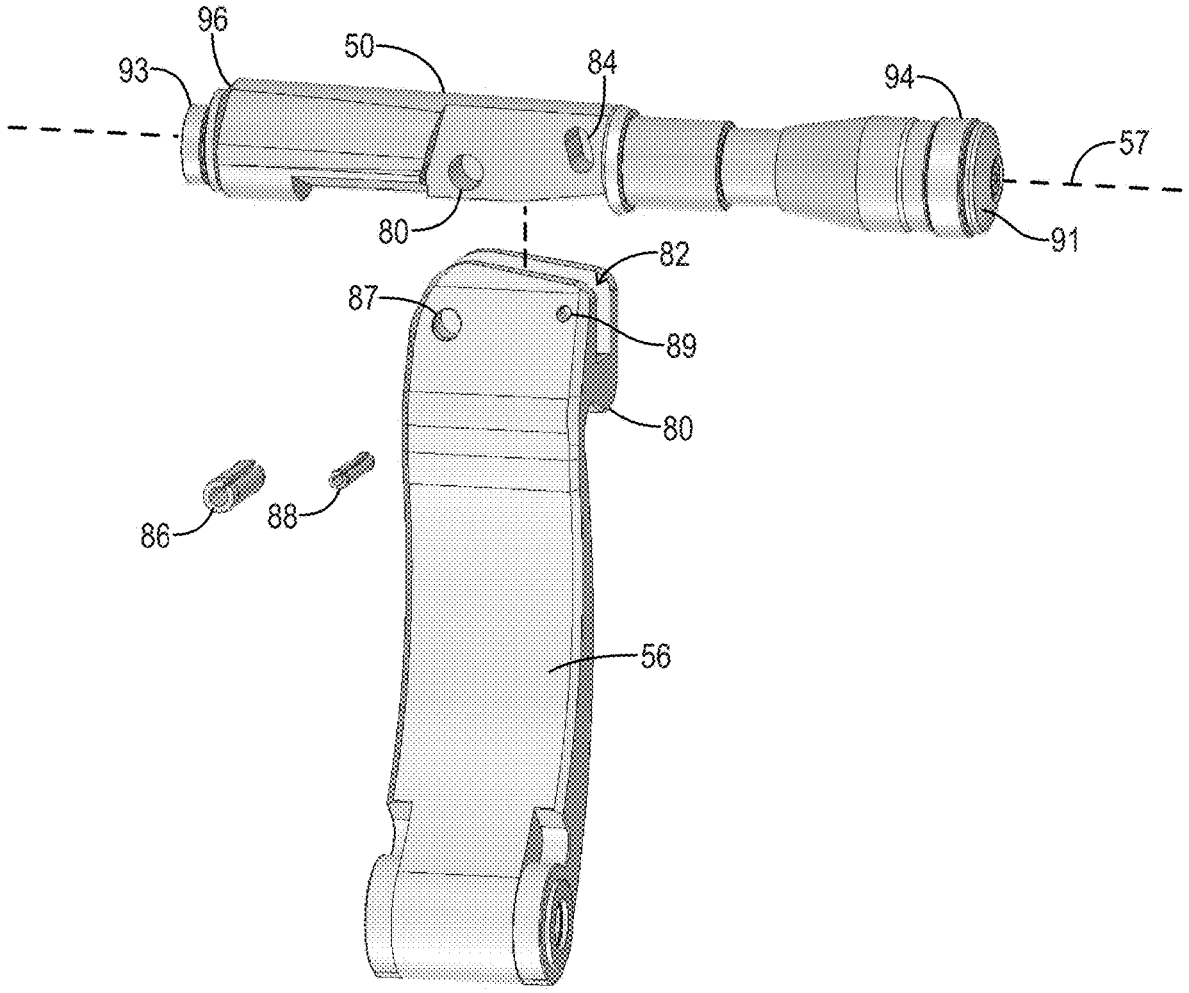
FIG. 18 is an exploded front right-side isometric view of the objects of FIG. 17.
Figure 19:
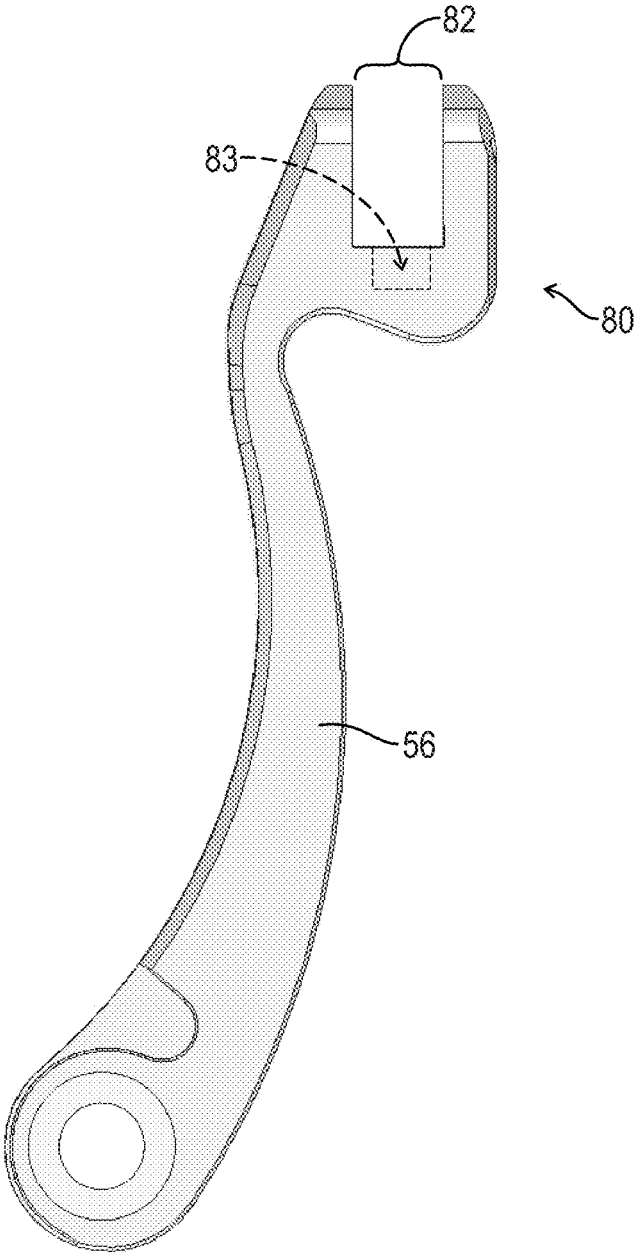
FIG. 19 is a front elevational view of the follower arm of FIG. 17, the rear view being a mirror image thereof.
Figure 20:
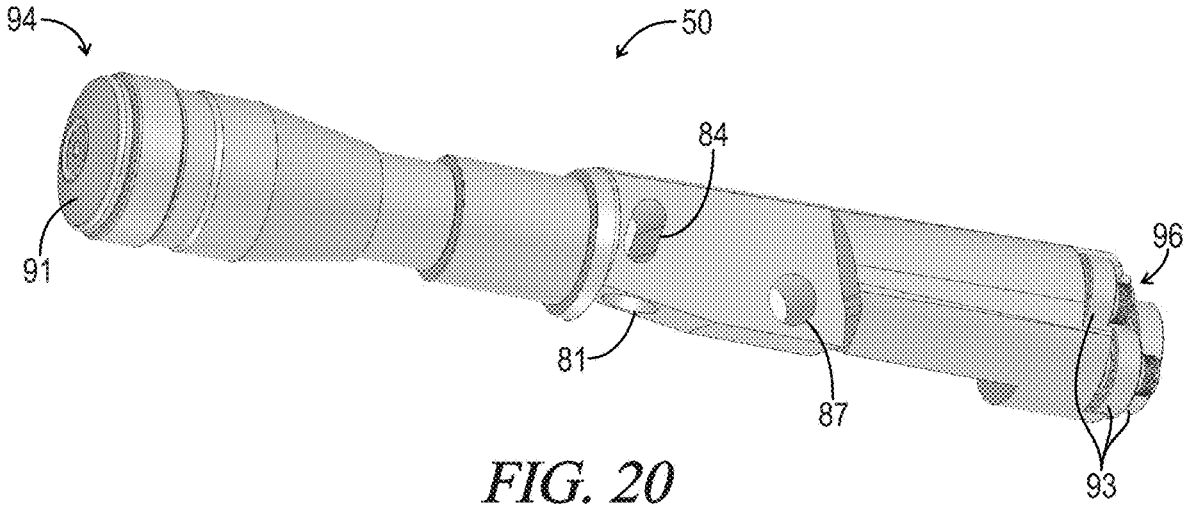
FIG. 20 is a depressed front left-side isometric view of the pivotable follower of FIG. 13 show in isolation.

As best shown in FIG. 8, in order to avoid undesirable contact between the bolt carrier group 110 and the follower 50, the novel follower 50 disclosed herein is also designed to cease upward movement and rest within the feed tower 20 below the gap 30 in the rear wall 28 of the feed tower 20 upon exhaustion of ammunition or manual removal from the interior space 15 of the last cartridge L. This ensures that the follower 50 remains outside of the bolt path 54 during cycling of the firearm, thereby overcoming the deficiencies of the prior art associated with tapered cartridges. Avoidance of contact between the follower 50 and the bolt carrier group 110 is due in part due to the pivotability of the follower 50 and in part to the manner in which the follower 50 is driven through the interior space 15, as explained in further detail below.

Turning to FIGS. 9-16, the ammunition magazine 10 includes front and rear drum plates 34, 36, rear sprocket 46, front sprocket 48, cartridge neck control ring 38, follower arm 56, center axle 58, center axle spring retainer 60, spring axle 61, center axle bearings 62, spring adjusting collar 63, spring retainer 64, five drum spacers 66, five drum spacer sleeves 68, spring adjusting collar 70, right tower portion 72, left tower portion 74, three sprocket connecting bars 76, and a mainspring or "clock spring" 78. The clock spring can be a spiral wound torsion spring.

The front and rear drum plates 34, 36, rear sprocket 46, and front sprocket 48 are all connected via and spaced along the center axle 58. The right and left tower portions 72, 74 are rigidly secured to the front and rear drum plates 34, 36 via threaded fasteners. Center axle bearings 62 are seated on opposing interior surfaces of the front and rear drum plates 34, 36. The front and rear drum plates 34, 36 and cartridge neck control ring 38 are connected via the drum spacers 66. The drum spacer sleeves 68 fit over the drum spacers 66. The sprocket connecting bars 76 connect the rear sprocket 46 to the front sprocket 48 so that both sprockets 46, 48 rotate inside the drum together. The sprockets 46, 48 rotate with the center axle 58 on the axle bearings 62, while the front and rear drum plates 34, 36 and the cartridge neck control ring 38 remain stationary (i.e., fixed). The spring retainer 64 is secured to the rear drum plate 36. The spring axle 61 is seated in the center axle spring retainer 60, which is seated in the center axle 58. The spring adjusting collar 63 is connected to the center axle spring retainer 60. The clock spring 78 is connected at one end to the center axle spring retainer 60 on the center axle 58 and at the other end to the spring retainer 64 on the rear drum plate 36. In this way, the clock spring 78 uses the center axle 58 as an arbor so that loading cartridges 2 into the interior space 15 of the magazine body 12 (i.e., loading cartridges into the cartridge seats 47 on the sprockets 46, 48) stores energy in the spring 78 by twisting the spiral tighter. The spring adjusting collar 70 connects the center axle spring retainer 60 to the center axle 58. The follower arm 56 is pivotably connected to the rear sprocket 46 and the front sprocket 48 so that the follower arm 56 moves around the interior space 15 with the sprockets 46, 48 as the sprockets 46, 48 rotate.

In use, manually loading cartridges 2 into the interior space 15 (i.e., placing cartridges in the cartridge seats 47 on the sprockets 46, 48) winds the clock spring 78, which stores potential energy therein. The clock spring 78 applies a biasing force against the center axle 58 and connected sprockets 46, 48 which is in turn transmitted to the follower arm 56 and connected follower 50 to bias cartridges 2 received in the interior space 15 around the drum and toward the upper end of the feed tower 20. The clock spring 78 releases stored energy to turn the center axle 58 and the connected sprockets 46, 48, and thus advance the follower arm 56 and connected follower 50, around the drum 18 and up into the feed tower 20 each time a topmost cartridge 5 is removed from the hollow space 42 under the feed lip 40 at the upper end of the feed tower 20. The sprockets 46, 48 at least partially support or carry cartridges 2 seated in the cartridge seats 47 around the interior space 15 of the drum 18. The sprockets 46, 48 also drive the follower arm 56, which carries the follower 50 around the interior space 15 of the drum 18 to bias cartridges 2 from the drum 18 up into the feed tower 20 and toward the at least one feed lip 40. The length of the follower arm 56 controls how far up into the feed tower 20 the follower 50 can move before coming to a rest upon exhaustion or removal of the last cartridge L from the interior space 15 of the feed tower 20.

As best shown in FIGS. 17-20, the follower 50 is pivotably connected to a distal end 80 of the follower arm 56. More specifically, the distal end 80 of the follower arm 56 defines a slot 82 in which the follower 50 is received. The follower 50 defines an arcuate control groove 84 extending laterally through the follower 50. A first pivot pin 86 extends through coaxially aligned holes 87 in the follower and the distal end 80 of the follower arm 56. A second pivot pin 88 extends through the arcuate groove 84 and a pair of coaxially aligned holes 89 in distal end 80 of the follower arm 56. The follower 50 is pivotable relative to the follower arm 56 about the first pivot pin 86 between an extended position in which the follower 50 (i.e., the follower axis 57) is parallel to the drum axis 17, and a depressed position in which the follower 50 (i.e., the follower axis 57) is at an angle 52 to the drum axis 17. The arcuate control groove 84 limits the range of pivotable motion of the follower 50 relative to the follower arm 56 via contact between the second pin 88 and the ends of the groove 84. The follower 50 being seated in slot 82 on follower arm 56 advantageously limits the degrees of movement of the follower 50 as it moves around inside the drum portion 18.

The follower 50 can be biased toward the extended position by a spring (not shown) seated between the follower 50 and the follower arm 56. One end of the spring can be seated in an aperture 81 formed in a bottom surface of the follower 50, and the other end of the spring can be seated in a corresponding opposing aperture 83 formed on a surface of the slot 82 in the distal end 80 of the follower arm 56. Use of a spring (not shown) between the follower 50 and the follower arm 56 to maintain the follower 50 in the extended position relative to the follower arm 56 can assist with maintaining the follower 50 (and cartridges 2 received in the drum 18) in a substantially parallel orientation relative to the drum axis 17, which ensures that cartridges 2 move smoothly around the drum axis 17.

The front drum plate 34 includes a generally circular channel 90 defined in a rear surface thereof. The rear drum plate 36 includes a corresponding generally circular channel 92 defined in a forward surface thereof. The channels 90, 92 in the front and rear drum plates 34, 36 are longitudinally spaced along and rotationally aligned about the drum axis 17 so as to define an internal track 95 extending around the drum 18. Cartridges 2 received in the interior space 15 of the drum 18 ride around the drum 18 in the track 95. More specifically, the rear end of each cartridge 2 rides in the back circular channel 92 while the tip of each cartridge 2 rides in the front circular channel 90. The follower 50 also rides in the track 95 behind the cartridges. That is, the front and back ends 94, 96 of the follower 50 are respectively received in the front circular channel 90 and the back circular channel 92. As the sprockets 46, 48 rotate and drive the follower arm 56 and pivotably connected follower 50 around the drum axis 17 inside the drum 18, the front and back ends 94, 96 of the follower 50 ride along the front and back channels 90, 92. A rear feed ramp 98 connected to the rear drum plate 36 assists in directing a rear portion of each cartridge 2 upward out of the interior space 15 of the drum 18 and into the interior space 15 of the feed tower 20, while the cartridge neck control ring 38 assists in directing a forward portion (i.e., the neck) of each cartridge 2 out of the interior space 15 of the drum 18 and into the interior space 15 of the feed tower 20. The track 95 directs the follower 50 out of the interior space 15 of the drum 18 and into the interior space 15 of the feed tower 20 in the same way. Put another way, upward facing curves 99 in the front and back channels 90, 92 contact the front and back ends 94, 96 of the follower 50 and direct the follower 50, when propelled by the follower arm 56 on the rotating sprockets 46, 48, along the curves 99 upward out of the drum 18 and into the feed tower 20. The stack of cartridges 2 constrains the angle of the follower 50 relative to the drum axis 17 until the last cartridge L is removed from the feed tower 20. After the last cartridge L has exited the feed tower 20, the location of the follower 50 in the track 95 controls the angle of the follower 50 and follower axis 57 relative to the drum axis 17.

The follower 50 can include a rounded follower cap 91 connected to one or both ends 94, 96 of the follower 50 to smooth contact between the follower 50 and the surfaces of the track 95. In some embodiment, the follower 50 can include one or more roller bearings 93 at one or both ends 94, 96 of the follower 50 to ensure that the follower 50 moves smoothly around the track 95.

The above description is only a preferred and feasible embodiment of this application, and is not intended to limit the patentable scope of this application. Although embodiments of the present invention have been described in detail, it will be understood by those skilled in the art that various modifications can be made therein without departing from the spirit and scope of the invention as set forth in the appended claims. For example, in other embodiments, the feed stop can be on a left side of the upper end of the magazine body while the feed lip can be on the right side of the upper end of the magazine body, and the handedness of the follower 50 and internal track 95 in which the follower 50 rides can be reversed. Additionally, it should be understood that the follower 50 disclosed herein can be used in ammunition magazines which lack feed stop 14 and instead employ a pair of traditional feed lips at the upper end of the magazine body.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. An ammunition magazine for a gun, comprising:

a magazine body defining an interior space in which a plurality of cartridges is receivable, the magazine body including a drum portion having a drum axis and a tower portion having at least one feed lip at an upper end thereof;

a follower in the interior space defining a follower axis and configured to bias the cartridges from the drum portion up through the tower portion toward the at least one feed lip; and a follower arm in the interior space configured to bias the follower around the drum portion and up into the tower portion;

wherein the follower is pivotably connected to the follower arm such that the follower pivots relative to the follower arm and an angle of the follower axis relative to the drum axis changes as the follower arm moves the follower from the drum portion to the tower portion.

2. The ammunition magazine of claim 1, wherein the follower is configured to pivot relative to the drum axis as the follower moves from the drum portion to the tower portion.

3. The ammunition magazine of claim 1, wherein the follower moves around the drum portion substantially parallel to the drum axis and up through the tower portion at an angle to the drum axis.

4. The ammunition magazine of claim 1, wherein the follower is configured to present a last cartridge received in the interior space tangent to the at least one feed lip.

5. The ammunition magazine of claim 1, wherein the follower is configured to bias a last cartridge received in the interior space evenly against the at least one feed lip.

6. The ammunition magazine of claim 1, wherein the follower is configured to rest within the tower portion of the magazine body outside of a path of an advancing bolt of the gun upon removal from the interior space of a last cartridge received in the interior space.

7. The ammunition magazine of claim 6, wherein:

the tower portion of the magazine body includes first and second opposing sidewalls, a rear wall extending between the first and second opposing sidewalls, and a gap in the rear wall through which the advancing bolt can pass during cycling of the gun; and the follower is configured to rest within the tower portion below the gap in the rear wall upon removal from the interior space of the last cartridge.

8. The ammunition magazine of claim 1, wherein the follower is pivotably mounted to a distal end of the follower arm.

9. The ammunition magazine of claim 8, wherein:

the distal end of the follower arm defines a slot; and the follower is received in the slot.

10. The ammunition magazine of claim 8, further comprising:

an arcuate groove extending through the follower;

a first pin about which the follower is pivotable extending through the follower and the distal end of the follower arm; and a second pin extending through the arcuate groove and the distal end of the follower arm.

11. The ammunition magazine of claim 1, wherein the follower is pivotable relative to the follower arm between an extended position in which the follower axis is parallel to the drum axis, and a depressed position in which the follower axis is at an angle to the drum axis.

12. The ammunition magazine of claim 11, wherein the follower is biased toward the extended position.

13. The ammunition magazine of claim 1, wherein the plurality of cartridges is receivable in the interior space in a single stack orientation.

14. The ammunition magazine of claim 1, wherein:

the magazine body defines an internal track in which the follower rides; and the internal track controls the angle of the follower axis relative to the drum axis.

15. The ammunition magazine of claim 14, further comprising:

a rotary member in the interior space configured to at least partially support or carry at least a portion of the plurality of cartridges received in the drum portion of the magazine body;

a biasing member configured to rotate the rotary member; and the follower arm is pivotably connected to the rotary member;

wherein the follower arm carries the follower through the interior space to bias the cartridges from the drum portion up into the tower portion toward the at least one feed lip.

16. An ammunition magazine for a gun, comprising:

a magazine body defining an interior space in which a plurality of cartridges is receivable, the magazine body including a drum portion having a drum axis and a tower portion having at least one feed lip at an upper end thereof;

a follower in the interior space having a follower axis, the follower configured to bias cartridges received in the drum portion from the drum portion up through the tower portion toward the at least one feed lip; and a follower arm in the interior space configured to bias the follower around the drum portion and up into the tower portion;

wherein the follower is pivotably connected to the follower arm such that the follower axis is substantially parallel to the drum axis while the follower is in the drum portion and the follower axis is at an angle to the drum axis while the follower is in the tower portion.

17. The ammunition magazine of claim 16, wherein the follower is configured to rest within the tower portion of the magazine body outside of a path of an advancing bolt of the gun upon exhaustion from the interior space of a last cartridge received in the interior space.

18. The ammunition magazine of claim 16, wherein:

the tower portion of the magazine body includes first and second opposing sidewalls, a rear wall extending between the first and second opposing sidewalls, and a gap in the rear wall through which an advancing bolt of the gun can pass during cycling of the gun; and the follower is configured to rest within the tower portion below the gap in the rear wall upon exhaustion from the interior space of a last cartridge received in the interior space.

19. The ammunition magazine of claim 16, wherein a distal end of the follower arm defines a slot and the follower is pivotably mounted in the slot such that the follower can pivot relative to the follower arm as the follower moves from the drum portion to the tower portion.

20. An ammunition magazine for a gun, comprising:

a magazine body defining an interior space in which a plurality of cartridges is receivable, the magazine body including a drum portion having a drum axis and a tower portion having at least one feed lip at an upper end thereof;

a follower in the interior space having a follower axis, the follower configured to bias cartridges received in the drum portion from the drum portion and up through the tower portion toward the at least one feed lip;

a follower arm in the interior space configured to bias the follower around the drum portion and up into the tower portion;

wherein the follower is pivotably connected to the follower arm such that the follower is movable relative to the follower arm between an extended position in which the follower axis is parallel to the drum axis, and a depressed position in which the follower axis is at an angle to the drum axis.

21. An ammunition magazine for a gun, comprising:

a magazine body defining an interior space in which a plurality of cartridges is receivable, the magazine body including a drum portion having a drum axis and an upper end configured to interface with a receiver of the gun;

a follower in the interior space configured to bias the cartridges from the drum portion into the upper end and up into a receiver of the gun; and a follower arm in the interior space configured to bias the follower around the drum portion and up into the tower portion; wherein:

the follower is pivotably connected to the follower arm, an angle of the follower relative to the drum axis changes as the follower moves from the drum portion into the upper end, and the follower is configured to rest within the upper end of the magazine body outside of a path of an advancing bolt of the gun upon removal from the interior space of a last cartridge received in the interior space.

* * * * *